US006702041B2

(12) United States Patent
Runia

(10) Patent No.: US 6,702,041 B2
(45) Date of Patent: Mar. 9, 2004

(54) COMBINED LOGGING AND DRILLING SYSTEM

(75) Inventor: Douwe Johannes Runia, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/794,711

(22) Filed: Feb. 27, 2001

(65) Prior Publication Data

US 2001/0027879 A1 Oct. 11, 2001

(30) Foreign Application Priority Data

Feb. 28, 2000 (EP) ..... 00301586

(51) Int. Cl.[7] ..... E21B 47/01
(52) U.S. Cl. ..... 175/40; 166/60; 175/320
(58) Field of Search ..... 175/40, 50, 320; 166/66, 250.01, 254.2; 73/152.03, 152.43, 152.46

(56) References Cited

U.S. PATENT DOCUMENTS 3,112,442 A 11/1963 Bennett ..... 324/1
4,529,939 A * 7/1985 Kuckes ..... 166/250.17
4,570,481 A 2/1986 McLaurin
4,597,440 A * 7/1986 Pottier ..... 166/254.2
4,901,804 A * 2/1990 Thometz et al. ..... 166/66
5,184,692 A 2/1993 Moriarty
5,251,708 A * 10/1993 Perry et al. ..... 166/66
5,353,872 A * 10/1994 Wittrisch ..... 166/250.01
5,563,512 A * 10/1996 Mumby ..... 175/50
5,589,825 A 12/1996 Pomerleau ..... 340/854.9
6,269,891 B1 * 8/2001 Runia ..... 175/393
6,419,013 B1 * 7/2002 Milne et al. ..... 166/250.17

FOREIGN PATENT DOCUMENTS

GB 2196410 A 10/1987

OTHER PUBLICATIONS

International Search Report of Aug. 6, 2001.

* cited by examiner

*Primary Examiner*—Hoang Dang

(57) ABSTRACT

A system is provided for drilling and logging of a wellbore formed in an earth formation. The system comprises a drill string provided with an external recess extending in longitudinal direction of the drill string, a fluid passage for flow of drilling fluid from an upper end of the drill string to a lower end thereof, and a port providing fluid communication between the fluid passage and the recess. The system further comprises a logging tool string capable of passing through the fluid passage and from the fluid passage via the port into the recess, and a removable closure element adapted to selectively close the port.

12 Claims, 3 Drawing Sheets

COMBINED LOGGING AND DRILLING SYSTEM

FIELD OF THE INVENTION

The present invention relates to a system for drilling and logging of a wellbore formed in an earth formation. The invention furthermore relates to a drill string, a logging tool string and a logging collar for use in conjunction with the system of the invention.

BACKGROUND OF THE INVENTION

U.S. Pat. No. 5589825 discloses a system whereby a logging tool string is lowered through the longitudinal fluid channel of the drill string until the logging tool is located opposite a number of windows provide in the wall of the drill string. Logging signals pass from the logging tool through the windows into the earth formation. Only limited logging information can be obtained with this known system, due to the limited size of the windows. Furthermore, this system requires precise positioning of the logging tool relative to the windows.

U.S. Pat. No. 3112442 discloses a system whereby a logging tool passes through the fluid channel of a drill string until a number of electrodes of the tool pass through the fluid nozzles of the drill bit to below the drill bit. The electrodes are of limited size and have limited capacity for emitting and receiving logging signals. Another drawback of this system is that passage of the electrodes through the nozzles can be hampered by the shape and direction of the nozzles. Furthermore, in case the lower end part of the drill string contains Measurement While Drilling equipment (MWD) or a hydraulic downhole motor, lowering of the logging tool string to the drill bit is virtually impossible.

It is an object of the invention to provide a system for drilling and logging of a wellbore formed in an earth formation, which overcomes the drawbacks of the known systems, and which is robust and provides adequate logging information without hampering drilling operations.

It is another object of the invention to provide a drill string for use in conjunction with the system of the invention.

It is a further object of the invention to provide a logging tool string for use in conjunction with the system of the invention.

It is yet another object of the invention to provide a logging collar for use in conjunction with the system of the invention.

SUMMARY OF THE INVENTION

In accordance with the invention there is provided a system for drilling and logging of a wellbore formed in an earth formation, the system comprising a drill string provided with an external recess extending in longitudinal direction of the drill string, a fluid passage for flow of drilling fluid from an upper end of the drill string to a lower end thereof, and a port providing fluid communication between the fluid passage and the recess, the system further comprising a logging tool string capable of passing through the fluid passage and from the fluid passage via the port into the recess, and a removable closure element adapted to selectively close the port.

DETAILED DESCRIPTION

Figure 1:
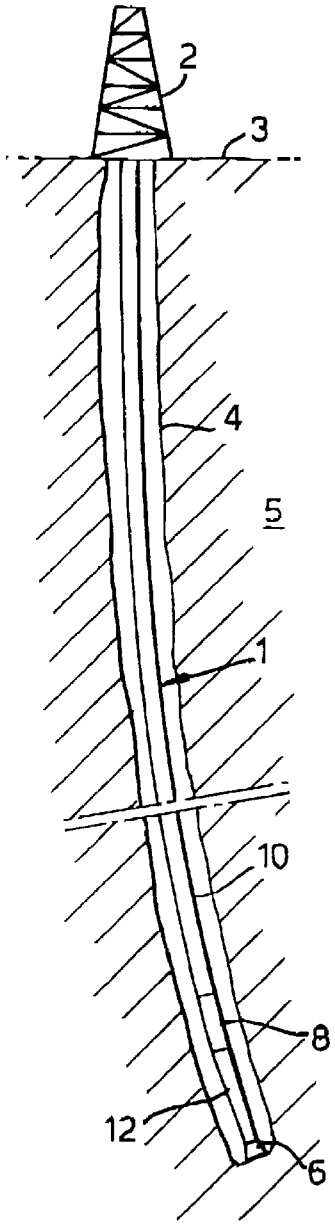
FIG. 1 schematically shows a drill string applied in an embodiment of the system according with to the invention.

By lowering the logging tool string through the fluid passage and removing the closure element, the logging tool string can be moved via the port into the external recess where the logging tool string becomes exposed to the exterior of the drill string. Subsequently the logging tool string is induced to conduct logging measurements, whereafter the logging tool string is retrieved into the fluid passage of the drill string. An important advantage of the system of the invention is that the recess can be located above certain drill string equipment present in the downhole assembly, such as MWD equipment or a downhole motor for driving the drill bit, so that lowering of the logging tool string is not hampered by the presence of such equipment.

Suitably the logging tool string is provided with connecting means for selectively connecting the logging tool string to the closure element.

Preferably the connecting means forms a secondary connecting means, and the closure element is provided with primary connecting means for selectively connecting the closure element to the drill string.

In an attractive embodiment, the drill string is provided with guide means for guiding the closure element along the recess in longitudinal direction thereof.

Suitably the guide means includes a pair of substantially parallel edges extending in longitudinal direction of the drill string, each edge forming a transition between the outer surface of the drill string and the recess.

The invention will be further described in more detail and by way of example with reference to the accompanying drawings in which like reference numerals relate to like components.

Referring to FIG. 1 there is shown a drill string 1 extending from a drilling rig 2 at the earth surface 3 into a wellbore 4 formed into an earth formation 5, the drill string 1 having a drill bit 6 arranged at the lower end thereof and a longitudinal fluid passage (not shown) for flow of drilling fluid from the drilling rig 2 to the drill bit 6. The lower end part of the drill string 1 includes a plurality of conventional drill string collars (not shown) and a logging collar 8 interposed between an upper part 10 of the drill string 1 and a lower part 12 of the drill string 1, which lower part 12 includes a downhole motor (not shown) for driving the drill bit 6.

Figure 1A:
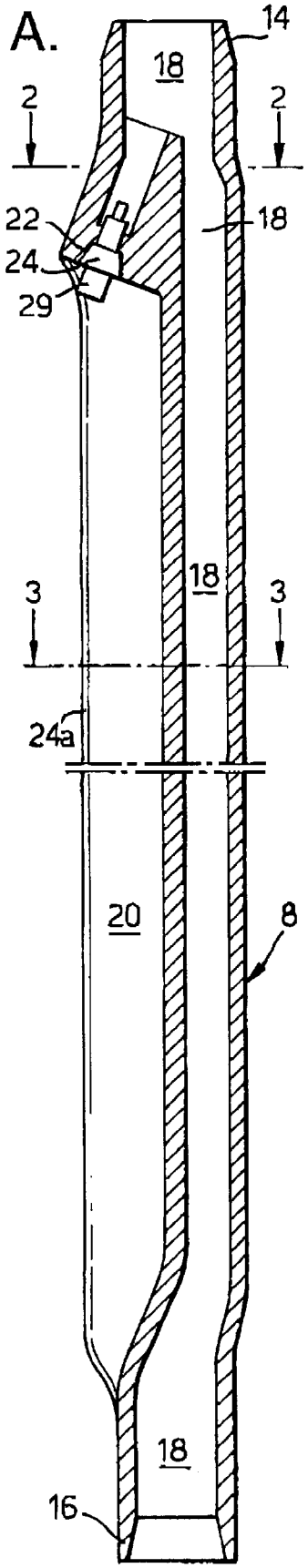
FIG. 1A schematically shows a logging collar of the embodiment of FIG. 1.
Figure 2:
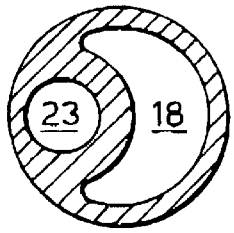
FIG. 2 schematically shows cross-section 2—2 of FIG. 1A.
Figure 3:
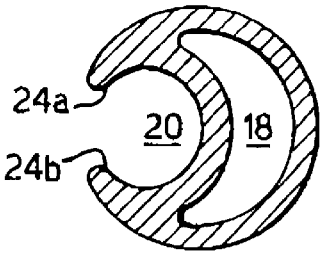
FIG. 3 schematically shows cross-section 3—3 of FIG. 1A.

In FIGS. 1A, 2 and 3 is shown in more detail the logging collar 8 which includes an upper connector 14 for connecting the logging collar 8 to the upper drill string part 10 and a lower connector 16 for connecting the logging collar 8 to the lower drill string part 12. The longitudinal fluid passage of the drill string 1 continues through the logging collar 8 in the form a channel 18 passing through the logging collar 8 throughout the length thereof. The logging collar 8 is provided with a recess 20 extending in longitudinal direction thereof, and a port 22. The port 22 is in direct fluid communication with the recess 20 and with the passage 18 via a bore 23 formed in the logging collar 8. The recess 20 defines a pair of substantially parallel edges 24*a*, 24*b* extending in longitudinal direction of the drill string 1, each edge 24*a*, 24*b* forming a transition between the outer surface of the drill string 1 and the recess 20. A removable closure element 24 is located in the port 22.

Figure 4:
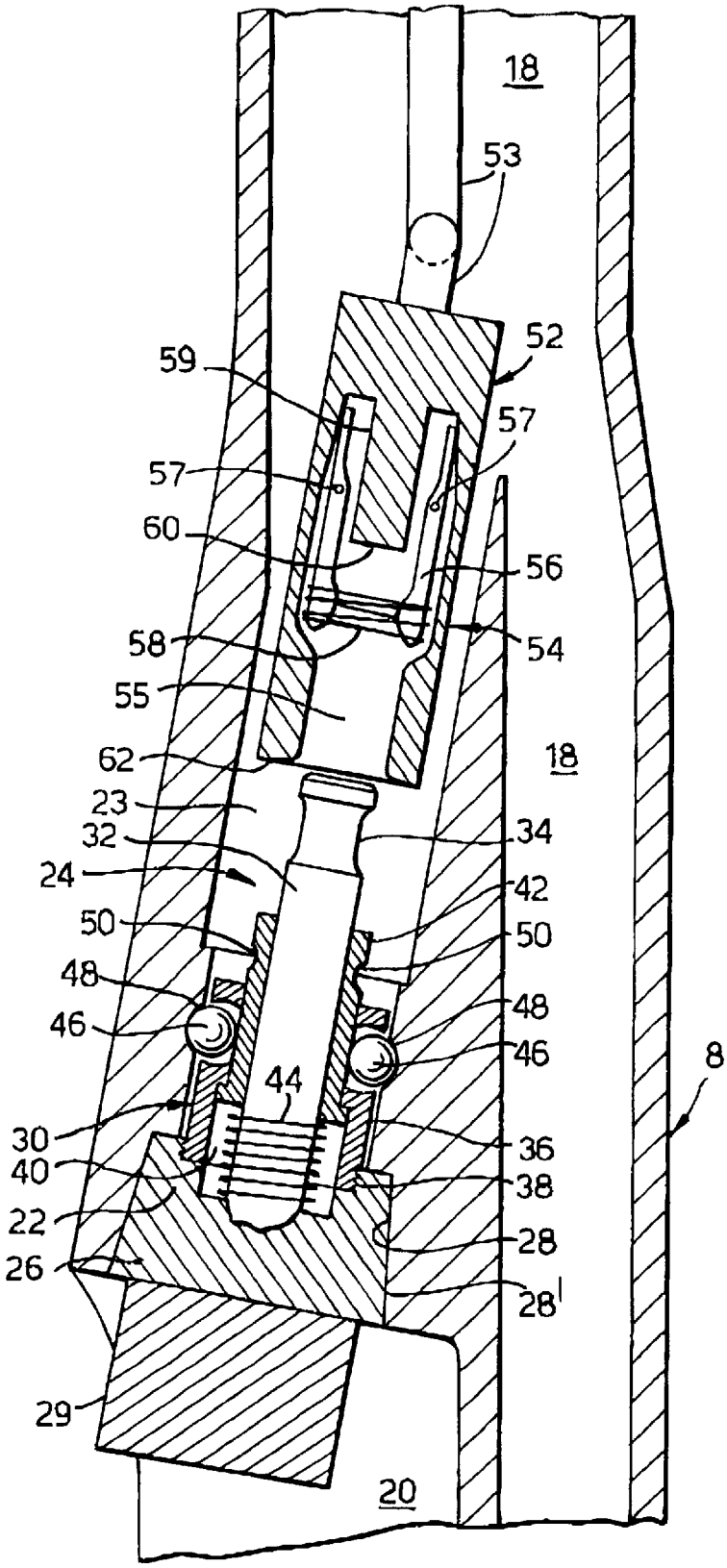
FIG. 4 schematically shows a detail of FIG. 1A whereby a logging tool string has been lowered into the logging collar.

Referring further to FIG. 4 there is shown a detail of the logging collar 8 including the port 22 and the closure element 24. The closure element 24 comprises an insert member 26 of frustoconical shape so as to allow removal of the insert member 26 from the port 22 in outward direction thereof, the port 22 and the insert member 26 having respective complementary contact surfaces 28, 28'. A guide element 29 is connected to the insert member 26 at the side thereof facing the recess 20, which guide element 29 will be described in more detail hereinafter with reference to FIG. 7. The closure element 24 furthermore comprises a primary latching device 30 including a post 32 extending into the bore 23. The post 32 is near the upper end thereof provided with an annular recess 34. A cylindrical cage 36 is connected to the insert member 26 by threaded connection 8 and extends concentrically around the post 32 with an annular space 40 between the cage 36 and the post 32. A cylindrical sleeve 42 extends in the annular space 40, the sleeve being slideable along the post 32 and being biased away from the insert member 26 by a spring 44. The cage 36 retains four metal locking balls 46 which extend into four locking recesses 48 provided in the wall of the bore 23. The sleeve 42 is provided with four releasing recesses 50 into which the locking balls 46 fit when the sleeve 42 is biased a sufficient distance against the force of the spring 44. For the purpose of clarity, only two locking balls 46, two locking recesses 48 and two releasing recesses 50 are shown.

A logging tool string 52 extends from surface via the longitudinal channel 18 into bore 23, the logging tool string 52 including a set of logging tools (referred to hereinafter), a power unit (not shown) and an electronic memory unit (not shown). The logging tool string 52 is assembled from a plurality of mutually hingeable sections 53 capable of passing through the passage 18 and from the passage 18 via the bore 23 into the recess 20. The logging tool string 52 includes a secondary latching device 54 arranged at the lower end of the logging tool string 52, the secondary latching device 54 having an interior space 55 of circular cross-sectional shape and of diameter corresponding to the overall diameter of the post 32 so that the post 32 fits into the interior space 55. The secondary latching device 54 is internally provided with four locking dogs 56 (only two of which are shown) capable of pivoting about pivoting points 57. A spring 58 is wound around the locking dogs 56 so as to bias the end parts of the locking dogs 56 facing the post 32, towards each other. The secondary latching device 54 is furthermore provided with a landing member 59 extending into the interior space 55 and having a landing surface 60 arranged such that when the post 32 extends into the interior space and contacts the landing surface 60, the locking dogs 56 are received in the annular recess 34 of the post 32. Furthermore, the secondary latching device 54 has a lower end surface 62 arranged at a longitudinal distance from the landing surface 60 such that when the landing surface 60 contacts the post 32, the lower end surface 62 biases the sleeve 42 to the position whereby the releasing recesses 50 are located opposite the respective locking balls 46.

Figure 5:
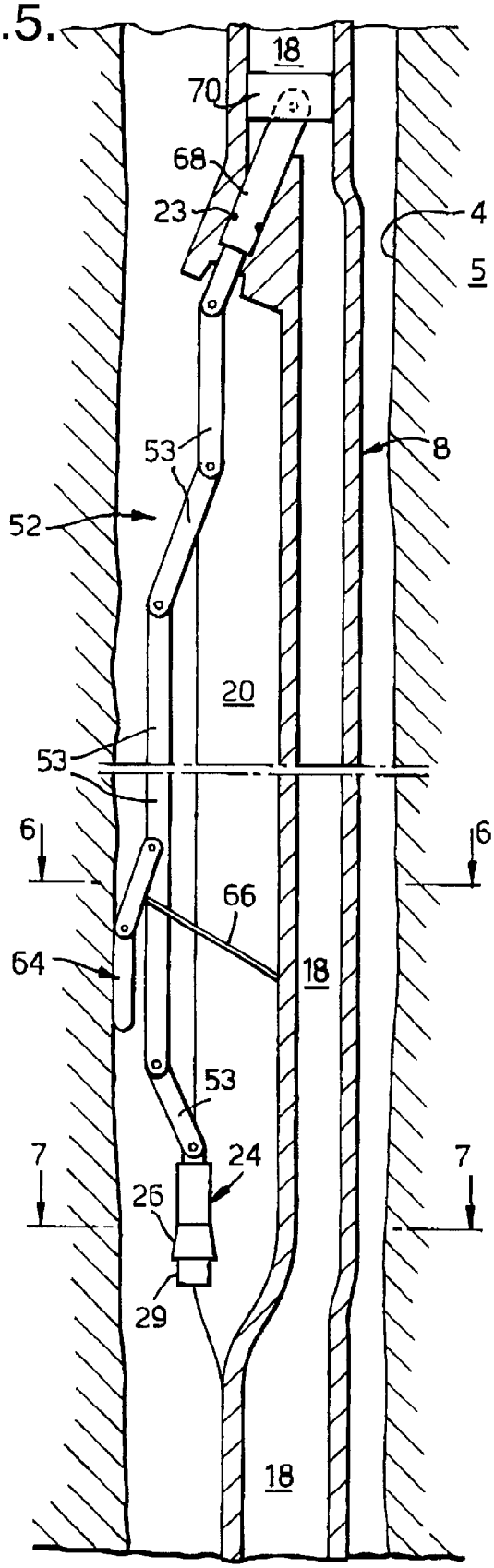
FIG. 5 schematically shows the logging collar of FIG. 1A whereby the logging tool string has been further lowered.
Figure 6:
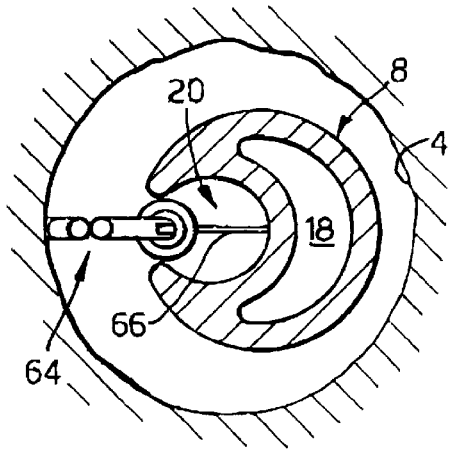
FIG. 6 schematically shows cross-section 6—6 of FIG. 5.
Figure 7:
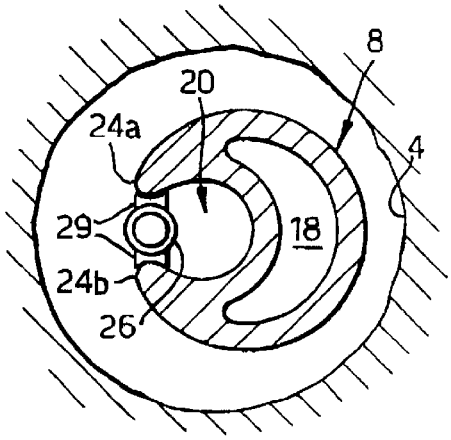
FIG. 7 schematically shows cross-section 7—7 of FIG. 5.

In FIGS. 5, 6 and 7 is shown the logging collar 8 whereby the logging tool string 52 extends from the channel 18 via the bore 23 into the recess 20. The logging tool string 52 includes the insert member 26 referred to hereinbefore, and furthermore a density logging tool 64 biased against the borehole wall by a calliper 66, a seal member 68 and a hydraulic pumping sub 70. The hydraulic pumping sub 70 is located in the channel 18 and is adapted to pump the logging tool string 52 through the drill string 1 into the logging collar 8, and the seal member 68 is located in the bore 23 and is adapted to thereby seal the bore 23.

Referring more specifically to FIG. 7 there is shown the insert member 26 with the guide element 29. As shown, the guide element 29 bridges the gap between the edges 24*a*, 24*b* and has opposite end surfaces of a shape substantially complementary to the shape of the edges 24*a*, 24*b* so that the guide element 29 is allowed to be guided in longitudinal direction along the edges 24*a*, 24*b* while being prevented from substantial radial movement relative to the logging collar 8.

During normal operation the drill string is operated to drill a new wellbore interval (not shown). During drilling the sleeve 42 is biased by spring 44 to the position shown in FIG. 4 so that the locking balls 46 are forced by the sleeve 42 into the respective locking recesses 48 provided in the wall of the bore 23, thereby latching the insert member 26 to the logging collar 8.

After drilling of the wellbore interval is completed the logging tool string 52 is lowered through the channel 18 of the drill string 1 by pumping the pumping sub 70 in downward direction through the channel 18, until the secondary latching device 54 moves into the bore 23. Subsequently the logging tool string 52 is further lowered so that the post 72 enters into the space 55 and contacts the landing surface 60 of the landing member 59. Simultaneously the lower end surface 62 of the secondary latching device pushes the sleeve 42 against the force of the spring 44 until the releasing recesses 50 become located opposite the respective locking balls 46. In this position the sleeve 42 no longer forces the locking balls 46 into the locking recesses 48 so that the insert member 26 becomes unlatched from the logging collar 8. Simultaneously the locking dogs 56 become engaged in the annular recess 34 of the post 32 and thereby latch the logging tool string 52 to the insert member 26. The logging tool string 52 with the insert member latched thereto is then further lowered through the recess 20 whereby the guide element 29 is guided in longitudinal direction along the edges 24*a*, 24*b* and is prevented from radial movement relative to the logging collar 8. Lowering of the logging tool string 52 is stopped when the seal member 68 becomes located in the bore 23 and thereby seals the bore 23 The density logging tool 64 is then operated to conduct a logging measurement whereby the logging date are stored in the electronic memory unit.

After logging is completed, the logging tool string 52 is lifted until the insert member 26 enters the port 22. The logging tool string 52 is then further lifted thereby unlatching the locking dogs 56 from the annular recess 34 and allowing the sleeve 42 to slide along the post 32 away from the insert member 26 by the action of the spring 44. The sleeve 42 thereby forces the locking balls 46 into the respective locking recesses 48 so that the insert member 26 becomes latched to the logging collar 8 and covers the port 22.

A further wellbore interval can then be drilled and logged in the manner described above, or the drill string 1 can be retrieved to surface if necessary.

Instead of lowering the logging tool string by pump-down technique, the string can be lowered by wireline or by a combination of wireline and pump-down technique. Lifting of the logging tool string can be done by wireline, by reverse pumping (i.e. pumping fluid from the annular space between the drill string and the wellbore wall/casing into the drill string), or by a combination thereof.

The logging data stored in the electronic memory unit can be retrieved after retrieval of the logging tool string to surface, after retrieval of the drill string with the logging tool string contained therein to surface, or by transferring the logging data from the electronic memory unit to surface using suitable signal transfer means while the logging tool string is still located downhole.

I claim:

1. A system for drilling and logging of a wellbore formed in an earth formation, the system comprising a drill string provided with an external recess extending in a longitudinal direction of the drill string, a fluid passage for flow of drilling fluid from an upper end of the drill string to a lower end thereof, and a port providing fluid communication between the fluid passage and the external recess, the system further comprising a logging tool string capable of passing through the fluid passage and from the fluid passage via the port into the external recess, and a removable closure element adapted to selectively close the port.

2. The system of claim 1, wherein the logging tool string is provided with connecting means for selectively connecting the logging tool string to the closure element.

3. The system of claim 2, wherein said connecting means forms secondary connecting means, and the closure element is provided with primary connecting means for selectively connecting the closure element to the drill string.

4. The system of claim 3, wherein the primary connecting means includes a primary latching device for latching the closure element to the drill string.

5. The system of claim 2, wherein said connecting means includes a secondary latching device for latching the logging tool string to the closure element.

6. The system of claim 4, wherein said connecting means includes a secondary latching device for latching the logging tool string to the closure element.

7. The system of claim 6, wherein the primary and secondary latching devices are arranged so as to unlatch the closure element from the drill string upon latching of the logging tool string to the closure element.

8. The system of claim 2, wherein the drill string is provided with guide means for guiding the closure element along the recess in longitudinal direction thereof.

9. The system of claim 8, wherein the guide means includes a pair of substantially parallel edges extending in longitudinal direction of the drill string, each edge forming a transition between the outer surface of the drill string and the recess.

10. The system of claim 1, wherein the logging tool string includes at least one logging tool and a plug member arranged to close the port when each logging tool has passed from the passage via the port into the recess.

11. The system of claim 1, wherein the drill string includes a logging collar, and wherein said recess is formed in the logging collar.

12. The system of claim 11, wherein the logging collar is provided with a channel for drilling fluid to flow from said passage via the channel to the lower end of the drill string.

* * * * *